United States Patent [19]

Soporowski

[11] Patent Number: 4,698,928

[45] Date of Patent: Oct. 13, 1987

[54] SIGN HOLDER

[75] Inventor: Andrzej L. Soporowski, Freeport, N.Y.

[73] Assignee: Esselte Pendaflex Corporation, Garden City, N.Y.

[21] Appl. No.: 796,327

[22] Filed: Nov. 7, 1985

[51] Int. Cl.[4] ..... G09F 3/18

[52] U.S. Cl. ..... 40/16.4; 40/605; 40/606; 40/152.1

[58] Field of Search ..... 40/605, 611, 16.4, 152.1, 40/606; 248/473

[56] References Cited

U.S. PATENT DOCUMENTS

| | | | |
|---|---|---|---|
| 3,313,054 | 4/1967 | Madey | 40/16.4 |
| 3,778,915 | 12/1973 | Freeman et al. | 40/605 |
| 3,787,922 | 1/1974 | Foy et al. | 248/473 |
| 4,044,485 | 8/1977 | Hopp | 40/16.4 |
| 4,222,181 | 9/1980 | Cummings | 40/605 |
| 4,377,046 | 3/1983 | Johnson | 40/16.4 |
| 4,604,820 | 8/1986 | Edman | 40/605 |

*Primary Examiner*—Gene Mancene
*Assistant Examiner*—Cary E. Stone
*Attorney, Agent, or Firm*—Darby & Darby

[57] ABSTRACT

A sign holder assembly which is adapted to be slidably mounted on various supports by means of open longitudinal cylindrical recesses with parallel walls along the opening of the recess, and extending necks with longitudinal cylindrical projections at the end. The projections are receivable in the recesses and the parallel walls being the necks so that there is little pivoting between the sign and its support.

12 Claims, 5 Drawing Figures

SIGN HOLDER

BACKGROUND OF THE INVENTION

This invention relates to a sign holder assembly and, more particularly to improvements in the construction of the mounting features of the assembly.

In retail outlets, especially grocery stores, a variety of sign holders are used to display prices and to advertise special sales. Prices for items located on shelves are typically displayed in slotted frames at the forward edge of the shelf molding. Some can goods are displayed with signs clipped to the upper rim of the can as shown in U.S. Pat. No. 2,040,750 of Long. Unadvertised specials are often brought to the shopper's attention by signs hung from wires strung across the aisle or in front of displays. A sample of this type of sign is illustrated in U.S. Pat. No. 3,154,870 of Hopp. In some cases, signs with prongs are used to pierce food, e.g., fish, to identify the price of the item or free standing signs are located in showcases for the same purpose. Exemplary of the free standing signs is the one disclosed in U.S. Pat. No. 4,134,222 to Orsos.

The Orsos sign has a base which supports a horizontal longitudinal slot. The sign has a longitudinal cylindrical portion which fits in the slot so the sign portion is pivotable with respect to the base.

The wide variety of signs create a problem for the store owner in that he must keep a stock of these different devices. Thus it would be desirable for the store owner to have a sign holder assembly, for commercial display purposes, which may be readily mounted to elevated wires, easel supports, or shelf brackets, and which is formed from essentially the same parts. This would significantly reduce the number of sign parts he would be required to keep on hand.

SUMMARY OF THE INVENTION

It is an object of the present invention to provide a sign holder assembly which is adapted for a relatively rigid (non-pivotable) connection to elevated support wires, easel supports or shelf brackets.

It is a further object of the present invention to provide a sign assembly as described above which is additionally capable of securing a plurality of advertising panels of different sizes and shapes, on each of its front and back faces.

Yet another object of the present invention is to have a mounted sign holder assembly which will not inadvertently detach from a support.

The foregoing objects are achieved with a slotted sign panel having a longitudinal cylindrical recess at its top and a longitudinal cylindrical projection at its bottom. Wire hanging hooks and shelf mounting brackets with cylindrical projections are attachable to the upper cylindrical slot of the sign. Easel supports with cylindrical recesses are attachable to the bottom cylindrical projection of the sign.

In an illustrative embodiment of the invention a sign holder has a central longitudinal planar portion with slots to receive thin plastic sheets with pricing information. A cylindrical recess is located along the upper edge of the central portion and a longitudinal cylindrical projection extends from a neck along its lower edge. The cylindrical recess, cylindrical projection and slots may be one piece with the center portion or may be formed from two pairs of parallel and opposed arms attached along its top and bottom edges. The top arms define the recess and have opposed and inwardly projecting parallel walls located above the cylindrical recess. The holder may be mounted at its top to an object having a neck and a cylindrical projection from the end of the neck. The holder may also be attached at its bottom to an object having a cylindrical recess and opposed and inwardly projecting parallel walls above the projection. In each mounting construction, the opposed and inwardly projecting parallel walls of one piece abut the neck of the other piece, and the cylindrical projection slidably fits in the cylindrical recess, thus substantially eliminating the pivoting of the sign holder.

In a preferred embodiment, the slots which hold the pricing information are formed in part by a portion of each of the pairs of arms.

BRIEF DESCRIPTION OF THE DRAWINGS

The invention is illustrated with particular reference to the accompanying drawings in which.

DETAILED DESCRIPTION OF THE INVENTION

Figure 1:
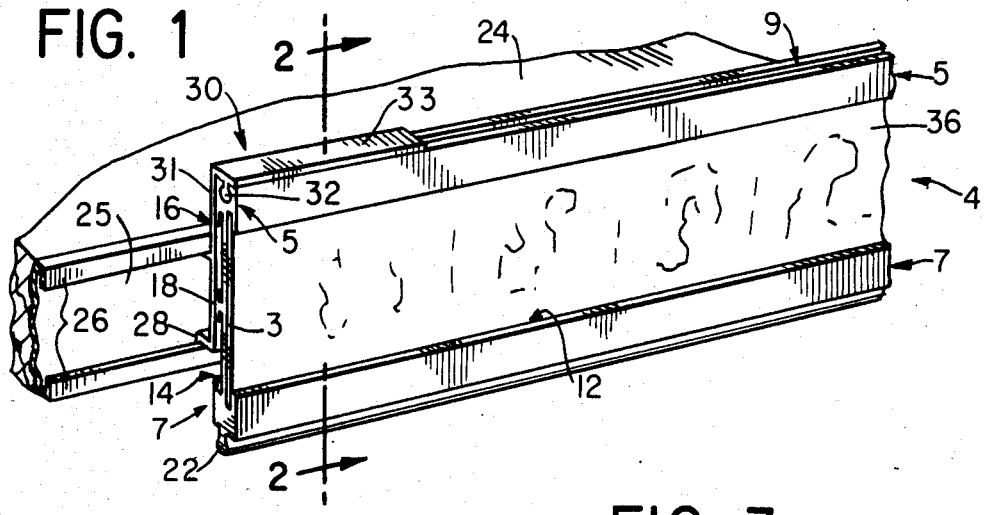
FIG. 1 is a perspective view of the sign holder assembly of the present invention as mounted to a stationary shelf bracket support.
Figure 2:
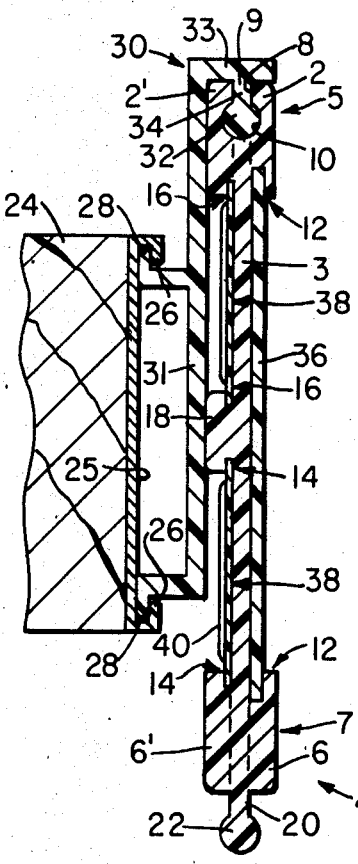
FIG. 2 is a cross section of the shelf mounted assembly taken along the line 2—2 of FIG. 1.

Referring to FIGS. 1 and 2, a thin rectangularly-shaped sign holder 4 has slots 12 on its front face to accept advertising or pricing information which is printed or embossed on thin plastic strips 36. On the back face of a center portion 3 there are two pairs of slots 14, 16 for receiving two rows of pricing strips 38, which when embossed have raised protrusions 40.

At the upper edge of sign holder 4 there is a longitudinal cylindrical recess 10. The recess 10 is located in an upper extension 5 which may be formed in one piece with center portion 3 of the sign holder or it may be created by a pair of parallel of arms 2, 2' (shown in dotted line) located on each side of center portion 3 along its upper edge. A second extension 7 which may be in one piece with center portion 3 is at the lower edge of portion 3. Alternatively, this extension 7 may be in the form of a second pair of parallel arms 6 (shown in dotted line), located on each side of center portion 3 along its lower edge.

On the rear face of the center portion 3 there is a longitudinal arm 18 spaced from the center portion by a small projection. Arm 18, as well as arms 2, 2' and 6, 6' may be extruded as one piece with the center portion or may be separate pieces fixed to the center portion by adhesive or other means.

Slots 12 are defined by the region between the front face of center portion 3, the lower portion of front arm 2 and the upper portion of front arm 6. Slots 14 are defined by the region between the back face of center portion 3, the lower portion of arm 18 and the upper portion of back arm 6'. Slots 16 are defined by the area between the back face of center portion 3, the lower portion of the rear arm 2' and upper portion of arm 18.

Cylindrical recess 10 is open toward its top by a groove 9. This groove is defined by a pair of opposed and inwardly projecting parallel walls 8 along the upper edge of arms 2, above the cylindrical portion of the recess 10. Along the lower edge of sign holder 4, below the lower portions of arms 6, there is a neck 20 with a longitudinal cylindrical member 22 projecting therefrom.

A grocery store shelf 24 has a typical shelf molding frame 25 at its forward edge. Frame 25 includes a pair of support slots 26 adapted to engage a pair of opposed fingers 28 of a mounting bracket 30 adapted to attach the sign holder 4 to the shelf. Bracket 30 and has a generally vertical section 31 to which fingers 28 are attached. At the top of section 31 there is a generally horizontal piece 33 that extends in the opposite direction from fingers 28. From piece 33 there is a downwardly depending neck portion 34 with a longitudinal cylindrical projection 32 at its end.

In order to mount the sign holder 4 to the shelf frame 25, the longitudinal recess 10 and the projection 32 are made so that the projection can be slid into the recess. The opposing walls 8 above the recess abut bracket neck 34.

Figure 3:
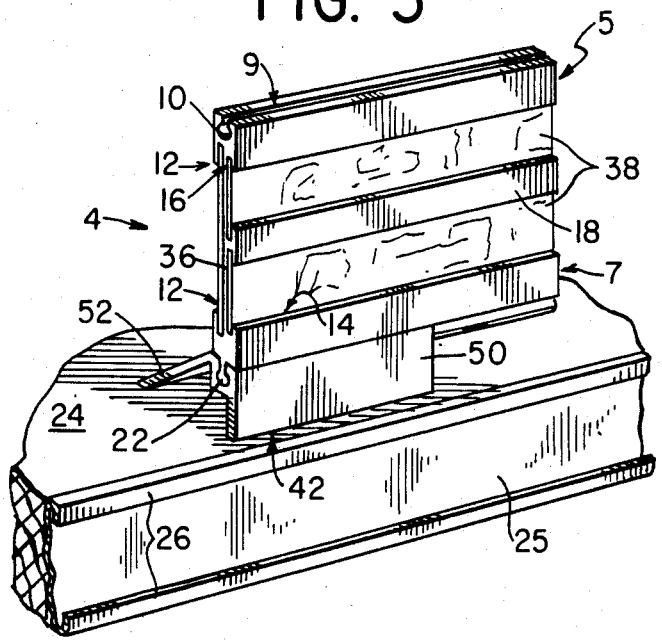
FIG. 3 is a perspective view of the sign holder assembly as mounted on a movable easel support.
Figure 4:
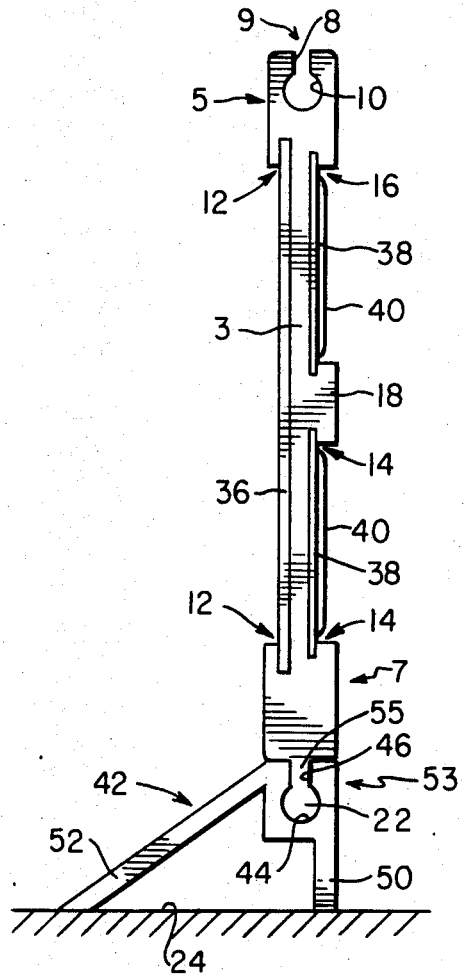
FIG. 4 is a side view of the sign arrangement of FIG. 3.

As shown in FIGS. 3 and 4, sign holder 4 is slidably mounted on movable easel support 42. Easel support 42, which may rest on a store shelf 24 or other generally horizontal surface (e.g. the base of a showcase) is provided with slanted legs 50, 52 which are joined at an upper portion 53. A groove 55 and a connected longitudinal cylindrical recess 44 are formed in the upper portion 53. The recess is adapted to receive the longitudinal cylindrical member 22, and inwardly projecting opposite parallel walls 46 of the groove 55 abut the neck 20.

Figure 5:
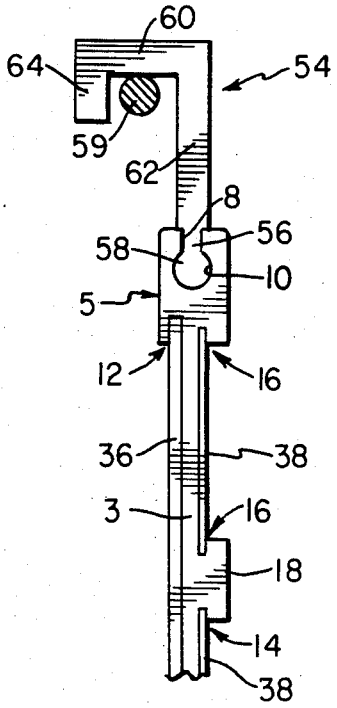
FIG. 5 is a fragmentary side view of the sign-holder assembly mounted on a hook for hanging from an elevated wire.

Referring to FIG. 5, the sign holder 4 is slidably mounted to hook 54, which has an inverse J-shaped cross section formed from a generally horizontal part 60 connecting a short leg 64 and a long leg 62 which extend downwardly from part 60. This hook 54 may be fastened to an elevated support wire 59 which is strung across an aisle of a store. In a construction analogous to the bracket of FIGS. 1 and 2, the leg 62 of the hook is provided with a neck 56 and a cylindrical projection 58 at the end of the neck. The latter is received by cylindrical recess 10, while the former is abutted by opposite walls 8.

In each of the illustrated embodiments of the present invention, the sign holder assembly is slidably mounted to either supports, brackets or hooks by a cylindrical recess-cylindrical projection connection. The cylindrical projection is introduced into the cylindrical recess by sliding the parts in opposite directions with respect to each other so that the projection is received in the cylindrical recess. The neck, which is adjacent to the cylindrical projection, is abutted on each of its sides by the pair of opposed and inwardly extending walls 8, 46. These inwardly extending walls engages the neck and prevent both the pivoting and the inadvertent detachment of the sign holder from the mounted support.

In a preferred embodiment of the present invention, both the sign holder assembly and the support clamp are formed of extruded plastic. The invention further contemplates forming the sign holder assembly in a one-piece unit, or in the alternative, attaching components to arrive at a construction embodying the invention.

Many modifications of the discussed embodiments may be made without departing from the spirit of the invention, which is defined and limited only by the appended claims.

What is claimed is:

1. A mountable sign holder assembly comprising:

a sign holder for carrying a plurality of informational indicia, said sign holder having two edges with longitudinal cylindrical structures, the informational indicia being located between the structures, one edge defines a longitudinal cylindrical holder recess which is open towards the one edge by a groove, said groove being defined by a pair of opposed and inwardly extending parallel holder walls, the other edge being in the form of a holder neck projecting away from the other edge and having a longitudinal cylindrical holder projection at the end; and means for mounting a support to at least one of the edges of the sign holder via the longitudinal cylindrical structures such that pivoting between said means for mounting and said sign holder is reduced by close contact with one of said holder walls and holder neck.

2. A mountable sign holder assembly as claimed in claim 1 wherein said means for mounting includes a bracket, at one end of said bracket there is a bracket neck with a longitudinal cylindrical bracket projection, said bracket projection being slidably receivable in said holder recess and said bracket neck being abutted by said holder walls, whereby pivoting of said bracket with respect to said holder is prevented by said holder walls bracing said bracket neck.

3. A mountable sign holder assembly as claimed in claim 2 wherein said means for mounting is a shelf mounting bracket further including fingers for engaging tracks of a shelf mounting frame.

4. A mountable sign holder assembly as claimed in claim 3 wherein said shelf mounting bracket has a generally vertical center portion with said fingers extending from one side, a generally horizontal piece extends from an upper part of said center portion of the side opposite said fingers, and said neck extends downwardly from said horizontal piece.

5. A mountable sign holder assembly as claimed in claim 2 wherein said means for mounting is a hook which is suspendable from a wire, said hook having a generally horizontal portion connecting short and long generally downwardly depending legs, said neck and longitudinal cylindrical projection being at the end of said long leg.

6. A mountable sign holder assembly as claimed in claim 1 wherein said means for mounting includes an easel with one end being adapted for mounting on a flat surface and the other end defining a longitudinal cylindrical easel recess which is open by a groove in a direction away from the other end, said groove being defined by a pair of opposed and inwardly extending parallel easel walls, said holder projecting being slidably received in said easel recess and said holder neck being abutted by said support walls, whereby pivoting of said holder with respect to said easel is prevented by said support walls bracing said holder neck.

7. A mountable sign holder assembly as claimed in claim 6 wherein the one end of the easel includes two legs arranged at angles to each other and extending from the other end.

8. A mounted sign holder assembly as claimed in claim 1 wherein said holder comprises a center portion against which said indicia are mounted, said holder recess and groove are formed by a pair of recess arms attached to a front and back surface of said center portion along one edge thereof and at a slight distance therefrom so as to create first slots, a pair of projection arms being attached to the front and back surfaces of said center portion along the other edge thereof and at a slight distance therefrom so as to create second slots, and thin strips with indicia thereon which are slidably received in the first and second slots on the front and rear surfaces of said center portion.

9. A mountable sign holdr assembly as claimed in claim 8 further including a median arm positioned longitudinally on the back surface between the back recess and projection arms, said median arm being spaced at slight distance from the back surface so as to create opposite third slots facing said first and second slots at the back surfaces of said center portion, said first, second and third slots on the back surface forming two pair of slots for receiving thin strips with indicia thereon on against said back surface.

10. A mountable sign holder assembly as recited in claim 8 wherein the means for mounting is an easel slidably mounted on a support surface, said cylindrical projection fitting in a cylindrical recess in the easel and said neck being abutted by a pair of opposed and inwardly extending easel walls located above the recess and defining a groove in an upper edge of the easel extending to of the cylindrical recess therein.

11. A mountable sign holder assembly as recited in claim 8 wherein the sign holder is adapted to slidably receive a shelf mounting bracket having a neck portion and a cylindrical bracket projection at the end thereof, said bracket being mountable to an edge molding frame of a shelf, said opposed and inwardly extending holder walls abutting said neck portion of said bracket and said cylindrical holder recess receiving said cylindrical bracket projection.

12. A mountable sign holder assembly as recited in claim 8 wherein the sign holder is adapted to slidably receive a hook, said hook having a leg at the end of which are a hook neck and a longitudinal cylindrical hook projection, said opposed and inwardly extending holder walls abutting said hook neck portion and said cylindrical holder recess receiving said cylindrical hook projection.

* * * * *